US005888348A

United States Patent [19]

Hampl, Jr.

[11] Patent Number: 5,888,348

[45] Date of Patent: Mar. 30, 1999

[54] METHOD FOR CONTROLLING THE PERMEABILITY OF A PAPER

[75] Inventor: Vladimir Hampl, Jr., Roswell, Ga.

[73] Assignee: Schweitzer-Mauduit International, Inc., Alpharetta, Ga.

[21] Appl. No.: 748,840

[22] Filed: Nov. 14, 1996

[51] Int. Cl.[6] ..... D21H 23/12

[52] U.S. Cl. ..... 162/139; 162/181.1; 162/181.2; 162/198; 162/252; 162/253; 162/259; 162/DIG. 10; 162/DIG. 11; 131/365

[58] Field of Search ..... 162/139, 181.1, 162/181.2, 259, 253, 252, 262, 183, 198, DIG. 10, DIG. 11; 131/365

[56] References Cited

U.S. PATENT DOCUMENTS

| | | | |
|---|---|---|---|
| 3,572,361 | 3/1971 | Tehar et al. | 162/DIG. 10 |
| 3,589,980 | 6/1971 | Salomon | 162/DIG. 10 |
| 3,620,915 | 11/1971 | Keyes, IV et al. | 162/198 |
| 3,936,665 | 2/1976 | Donoghue | 162/DIG. 11 |
| 4,411,279 | 10/1983 | Martin et al. . | |
| 4,461,311 | 7/1984 | Mathews et al. . | |
| 4,480,644 | 11/1984 | Luke . | |
| 4,622,983 | 11/1986 | Mathews et al. . | |
| 4,805,644 | 2/1989 | Hampl, Jr. et al. . | |
| 4,998,543 | 3/1991 | Goodman et al. . | |
| 5,060,675 | 10/1991 | Milford et al. . | |
| 5,074,321 | 12/1991 | Gentry et al. . | |
| 5,103,844 | 4/1992 | Hayden et al. . | |
| 5,107,866 | 4/1992 | Aronoff et al. . | |
| 5,109,876 | 5/1992 | Hayden et al. . | |
| 5,143,098 | 9/1992 | Rogers et al. . | |
| 5,161,551 | 11/1992 | Sanders et al. . | |
| 5,263,500 | 11/1993 | Baldwin et al. . | |

FOREIGN PATENT DOCUMENTS

| | | |
|---|---|---|
| 0447094A1 | 9/1991 | European Pat. Off. . |
| 0513985A1 | 11/1992 | European Pat. Off. . |
| 0791688A1 | 8/1997 | European Pat. Off. . |
| 002056890 | 5/1982 | Japan . |
| 0066599 | 4/1984 | Japan . |
| 1194298 | 8/1985 | Japan . |
| 002056698 | 10/1993 | Japan . |
| 405279993 | 10/1993 | Japan . |
| 405279994 | 10/1993 | Japan . |
| 249932 | 8/1969 | U.S.S.R. . |
| 249933 | 8/1969 | U.S.S.R. . |
| 2028832 | 3/1980 | United Kingdom . |

OTHER PUBLICATIONS

European Search Report dated Mar. 4, 1998.
Abstract Bulletin of the Instititute of Paper Chemistry; No. 6; Dec. 1988; Appleton, Wiscousin, Abst. No. 5870.
Specialty Minerals, Inc., 1993, p. 151.0, Albafil ® M Slurry.
Specialty Minerals, Inc., 1993, p. 251.1, Albaglos ® Dry.
Specialty Minerals, Inc., 1994, Ultrapaque ™ Slurry.

*Primary Examiner*—Peter Chin
*Attorney, Agent, or Firm*—Dority & Manning, P.A.

[57] ABSTRACT

The present invention is directed to a method for controlling and adjusting the permeability of a cigarette wrapping paper. Permeability is controlled in the paper by adding different sized filler particles in different proportionate amounts. Permeability of the paper is altered without having to change the total amount of filler in the paper. By selectively controlling the permeability of the paper, various characteristics and properties of a cigarette made with the paper can be likewise modified as desired. In one embodiment of the present invention, the permeability of a cigarette wrapper can be automatically maintained or adjusted as the paper is being made.

20 Claims, 3 Drawing Sheets

METHOD FOR CONTROLLING THE PERMEABILITY OF A PAPER

FIELD OF THE INVENTION

The present invention is generally directed to a method and to a system for controlling and adjusting the permeability of a paper. More particularly, the present invention is directed to a method for controlling the permeability of a cigarette paper by adding to the paper a mixture of fillers having different particle sizes and morphologies. The permeability of the paper can be controlled without varying the total filler amount contained within the paper.

BACKGROUND OF THE INVENTION

Cigarettes are conventionally made by wrapping a column of tobacco in a white wrapping paper. Cigarettes also usually include a filter joined to one end of the tobacco column by a tipping paper. Wrapping papers and tipping papers are typically made from flax or other cellulosic fibers and contain a filler, such as calcium carbonate.

Besides being used to hold the cigarette together and to provide the cigarette with an aesthetic appearance, cigarette wrapping papers also contribute to or control many physical properties and characteristics of the cigarette. For instance, cigarette wrapping paper can be used to control the rate in which the cigarette burns, the number of puffs per cigarette, and the total tar delivery per puff. Cigarette paper can also be used to limit the amount of smoke that emanates from the lit end of the cigarette when it is left burning. Further, cigarette paper is even used to reduce the tendency of cigarettes to ignite surfaces which come in contact with the cigarette and to cause the cigarette to self-extinguish when left unattended.

Perhaps the most important property of cigarette wrapping paper that is used to control the above-described characteristics of a cigarette is permeability. By increasing or decreasing the permeability of a wrapping paper, many changes occur in a cigarette made from the paper, including most importantly the overall taste of the cigarette.

In the past, many of those skilled in the art have devised various methods for controlling and adjusting the permeability of cigarette wrapping paper. For instance, one method of altering the permeability of wrapping paper is to vary the fiber furnish that is used to make the paper.

Another method of controlling permeability of a wrapping paper is to either increase or decrease the refining of the fiber furnish. Generally speaking, refining the fiber furnish to a greater extent causes a reduction in permeability. More particularly, refining the cellulosic material that is used to make the paper down into smaller sizes creates more surface area, which reduces permeability and leads to better formation.

A third way in which the permeability of cigarette paper is controlled is to change the amount of filler added to the paper. Increasing or decreasing the filler loading of the paper causes an increase or decrease in permeability respectively. As more filler is added to the paper, the filler tends to interfere with the hydrogen bonding between fibers creating the increase in permeability.

Of the above three methods, increasing or decreasing the filler level is perhaps the simplest method for adjusting permeability. Unfortunately, however, altering filler levels in cigarette paper also affects the burn rate of the cigarette independently of permeability. As burn rate changes, so does puff count and total tar delivery.

Other problems are also experienced when filler levels are altered. For instance, as filler content is increased, the strength of the paper is compromised. Conversely, when not enough filler is incorporated into the paper, the opacity of the paper significantly decreases, adversely affecting the appearance of the cigarette. Therefore, there is increasing pressure to keep filler levels in cigarette paper constant or at least within a preset range, thereby leaving the amount of refining and the selection of furnish as the only tools for permeability adjustments.

Thus, a need exists for a simple method of adjusting the permeability of a cigarette paper without adversely affecting various characteristics of the paper and without having to significantly alter the amount of filler contained within the paper. A need also exists for a method of controlling the permeability of cigarette paper that can be used in conjunction with refining adjustments and furnish selection. Further, there is also a need for a system that will automatically maintain or adjust the permeability of a paper as the paper is being made.

SUMMARY OF THE INVENTION

The present invention recognizes and addresses the foregoing disadvantages, and others of prior art constructions and methods.

In general, the present invention is directed to a method for controlling and adjusting the permeability of a cigarette wrapping paper. The permeability of the paper is adjusted by adding blends of different sized fillers to the paper. Through this process, the permeability of the paper can be altered without increasing or decreasing the total filler loading within the paper. As will be described in more detail hereinafter, the method of the present invention can be used to automatically control the permeability of the paper as it is being made.

Accordingly, it is an object of the present invention to provide an improved method of making cigarette wrappers.

Another object of the present invention is to provide a method for controlling the permeability of a cigarette wrapper.

It is another object of the present invention to provide a process for adjusting the permeability of a cigarette wrapper by adding different sized fillers to the paper, without varying the total filler content.

Still another object of the present invention is to provide a system for automatically controlling the permeability of a cigarette wrapper as the wrapper is being made.

It is another object of the present invention to provide a method for controlling the permeability of a cigarette wrapper by incorporating into the wrapper different sized particles of calcium carbonate.

These and other objects of the present invention are achieved by providing a process for adjusting the permeability of a paper wrapper for a smoking article. The process includes the steps of adding at least two different sized fillers to a paper wrapper. The proportionate amount of larger sized fillers in relation to smaller sized fillers is then selectively increased or decreased for increasing or decreasing the permeability of the paper wrapper respectively.

According to the present invention, the permeability of the paper wrapper can be adjusted without having to increase or decrease the total amount of fillers in the paper. In particular, the filler loading in the paper can remain constant and can be between about 20% to about 40% by weight and more particularly between about 25% to about 35% by weight. The basis weight of the paper wrapper can be between about 18 gsm to about 60 gsm and more particularly between about 22 gsm to about 32 gsm. Through this process, a paper wrapper can be formed having a permeability anywhere from about, for instance, 5 Coresta units to about 80 Coresta units.

The fillers added to the paper wrapper can be calcium carbonate. The fillers can have median particle sizes ranging from about 0.05 microns to about 15 microns.

In one embodiment, two different sized fillers can be added to the paper wrapper. The first filler can be calcium carbonate and have a median particle size of from about 0.2 microns to about 0.4 microns. The second filler, on the other hand, can also be calcium carbonate and can have a median particle size of from about 1.5 microns to about 2.5 microns. The first filler and the second filler can be added to the paper wrapper in different proportions in order to adjust the permeability of the wrapper.

These and other objects of the present invention are also achieved by providing a system for controlling the permeability of a paper as the paper is being made. The system includes a paper forming device adapted to form a continuous sheet of paper from a fiber suspension. A plurality of filler reservoirs are placed in communication with the paper forming device for blending a corresponding plurality of filler slurries with the fiber suspension. Each of the filler slurries contains a filler having a different median particle size. A plurality of flow control devices can be used for controlling the flow rate of each of the filler slurries from the filler reservoirs to the paper forming device.

The system can also include a permeability measuring device for measuring the permeability of the sheet of paper as it is formed. The permeability measuring device can send permeability information to a controller which is electrically connected to the flow control devices. The controller can thereby maintain the sheet of paper within a preset permeability range by adjusting the flow control devices in response to permeability information received from the permeability measuring device.

The system can be used to control the permeability of the paper by blending the fiber suspension with a mixture of fillers having different median particle sizes. As paper is being formed from the fiber suspension, the permeability of the paper can be determined. Based on the permeability, the average particle size of the mixture of fillers can be selectively increased or decreased for adjusting the permeability of the paper within a preset range.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification including reference to the accompanying figures, in which.

Figure 1:
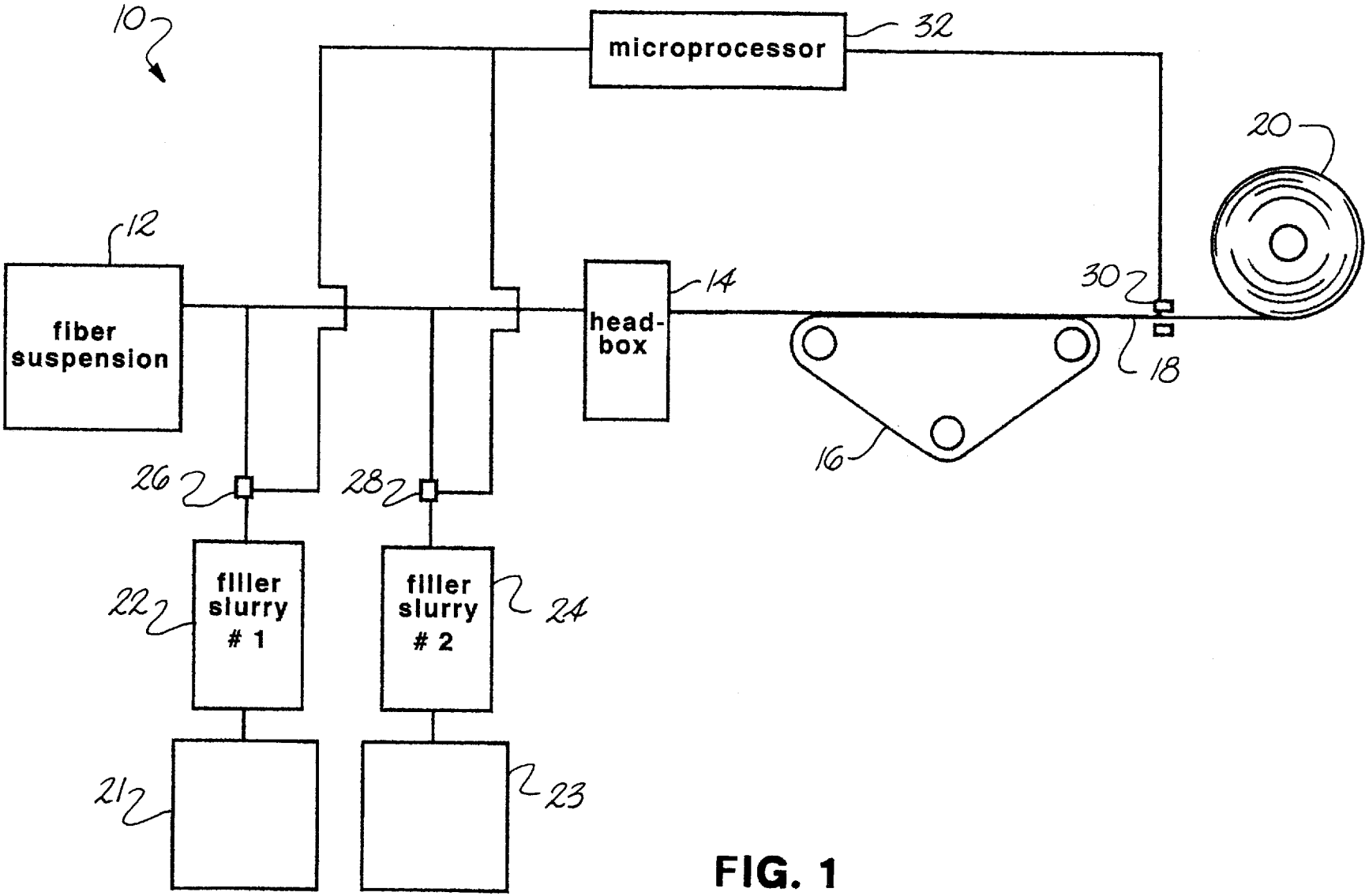
FIG. 1 is a plan view of one embodiment of a system made in accordance with the present invention.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary construction.

The present invention is generally directed to a method and a system for controlling the permeability of a paper wrapper for a cigarette. The permeability of the wrapper is controlled by incorporating into the wrapper two or more fillers having different sizes and shapes. According to the present invention, permeability can be controlled exclusively as a function of particle size regardless of the total amount of filler contained in the paper. In other words, the permeability of the paper can be controlled and adjusted without increasing or decreasing the total filler level.

More particularly, it has been discovered that smaller filler particles incorporated into cigarette paper lead to lower permeabilities, while larger particles create higher permeabilities. Thus, by varying the ratio of larger filler particles to smaller filler particles, the permeability of the paper can be altered without altering the total filler level.

Through the method of the present invention, the permeability of cigarette wrappers can be adjusted and varied to produce cigarettes with desired characteristics. For instance, by adjusting the permeability of a paper wrapper, the burn rate, puff count, and tar delivery of the cigarette can be selectively altered. Cigarette performance can thus be modified without increasing or decreasing the total filler level in the paper which may have negative impacts on the cigarette.

It is believed that any filler material may be used in the process of the present invention. Such fillers may include, for instance, titanium dioxide, magnesium carbonate, magnesium oxides, calcium carbonate, and the like. It is also within the scope of the present invention to mix different types of filler materials in order to get a broader range of particle sizes and morphologies. For instance, a smaller sized titanium dioxide filler may be combined with a larger sized magnesium carbonate filler. The following description will be primarily directed to the use of various calcium carbonate fillers since calcium carbonate is currently the most predominately used filler in cigarette wrappers. It should be understood, however, that the present invention is not limited solely to the use of calcium carbonate.

When fillers are added to a paper, the filler particles interfere with the fiber-to-fiber bonding occurring between the cellulosic fibers during formation of the paper. It is believed that the filler particles wedge themselves between adjacent fibers creating a void space and hence an increase in the porosity of the paper. It has been discovered through the present invention, that the degree to which the fiber-to-fiber bonding is disrupted by the filler depends not only on the number of particles, but also on the morphology of the particles. In particular, it is believed that as the size of the filler particles increases, the fibers are pried apart farther creating larger pores in the paper. As the proportion of larger filler particles increases, permeability increases, while as the proportion of smaller filler particles increases, the paper permeability decreases.

In one embodiment of the present invention, the permeability of a cigarette wrapper is controlled using two different fillers: a first larger sized filler and a second smaller sized filler. The larger sized filler in one preferred embodiment can have a particle size of from about 1.5 microns to about 2.5 microns while the smaller sized filler can have a particle size from about 0.1 microns to about 0.5 microns.

Both fillers can be added to a paper wrapper in a combined amount that is within a preset range. In particular, the total filler loading within the paper can be set at a particular point that produces desired characteristics. According to the present invention, to change the permeability of the paper without changing the loading, the ratio of larger sized particles to smaller sized particles added to the paper can be adjusted.

The total range of permeabilities that can be obtained according to this method will be between a paper wrapper made exclusively from the larger sized filler resulting in a paper with the highest permeability and a paper wrapper made exclusively from the smaller sized filler resulting in a paper with the lowest permeability. By changing the proportionate amount of the larger sized filler in relation to the smaller sized filler, a paper wrapper can be produced having a permeability that falls anywhere within the above described range. Of course, similar results can be obtained by using mixtures of more than two fillers if desired.

Various commercially available calcium carbonate fillers all marketed by Specialty Minerals, Inc. of Adams, Mass. that may be used in the process of the present invention include the following:

| TRADE NAME | MEDIAN PARTICLE SIZE |
|---|---|
| MULTIFEX MM | 0.07 microns |
| ULTRAPAQUE | 0.3 microns |
| ALBAFIL M | 0.8 microns |
| ALBAGLOS DRY | 0.8 microns |
| ALBACAR HO | 1.2 microns |
| ALBACAR 5970 | 1.9 microns |
| MARBLEWHITE | 15 microns |

The above calcium carbonate filler materials can be used in any combination in the present invention. In general, any filler having a particle size between about 0.05 microns to about 15 microns may be used in the process and particularly between about 0.05 microns and about 10 microns. In one preferred embodiment of the present invention, ULTRAPAQUE filler is used in combination with ALBACAR 5970 filler to adjust paper permeability.

As used herein, the particle size of a filler can be measured and determined by a sedimentation procedure using, for instance, a Sedigraph. Thus, all particle sizes listed above represent a median particle size.

The construction of a cigarette wrapping paper made in accordance with the present invention will now be discussed in greater detail. Generally, the wrapping paper can be made from cellulosic fibers obtained, for instance, from flax, softwood, or hardwood. The total filler loading added to the paper wrapper can be between about 20 percent to about 40 percent by weight, and particularly between about 25 percent to about 35 percent by weight. According to the present invention, the permeability of the paper is varied while filler loading remains within a desired range.

The permeability of cigarette paper can generally range from about 5 Coresta units to about 80 Coresta units. More particularly, conventional cigarette papers usually have a permeability between about 15 Coresta units and about 55 Coresta units. These permeability ranges can be obtained solely through the method of the present invention. The method of the present invention, however, can also be used in combination with conventional techniques. For instance, in one embodiment, the permeability of a cigarette wrapper can be adjusted not only by varying the average particle size of the filler but also by varying the amount of refining performed on the furnish.

The term, permeability, as used herein refers to the ability of a fluid, such as for example a gas, to pass through a particular porous material. The permeability of a material can be determined, for instance, utilizing an air permeability tester which measures the volume of air that passes through a material per unit time over a particular area. Permeability may be expressed in CORESTA units of centimeters per minute.

The basis weight of cigarette paper is usually between about 18 gsm to about 60 gsm and more particularly between about 22 gsm to about 32 gsm. The cigarette paper may also be treated with a burn control additive. Such burn control additives can include, for instance, alkali metal salts, acetates, phosphate salts, or mixtures thereof. A particularly preferred burn control additive is a mixture of potassium citrate and sodium citrate. The burn control additive can be added to the paper in an amount from about 0.3 percent to about 12 percent by weight, and more particularly between about 0.3 percent to about 3 percent by weight.

Referring to FIG. 1, one embodiment of a system generally 10 that may be used to produce cigarette papers according to the present invention is illustrated. System 10 includes a conventional paper making device in which a fiber suspension 12 is fed into a headbox 14. Fiber suspension 12 is typically formed from a fiber furnish that has been cooked in a digester, washed, bleached and refined. From headbox 14, fiber suspension 12 is spread out onto a screen or a set of screens 16 where a sheet of paper 18 is formed. Paper 18 can then be collected on a take-up roll 20.

In accordance with the present invention, system 10 further includes at least two reservoirs 22 and 24 adapted to hold aqueous slurries of different filler materials. In the embodiment shown in FIG. 1, system 10 includes filler slurry No. 1 which may contain a larger sized filler and filler slurry No. 2 which may contain a smaller sized filler. The filler slurries can be formulated and mixed in make-up tanks 21 and 23 and then fed to reservoirs 22 and 24 respectively.

Reservoirs 22 and 24 are adapted to blend filler slurry No. 1 and filler slurry No. 2 with fiber suspension 12. The filler slurries can be added to fiber suspension 12 directly from reservoirs 22 and 24 as shown in FIG. 1, or can be first premixed and then added to fiber suspension 12. In order to control the amount of each filler slurry added to the fiber suspension, system 10 includes flow control devices 26 and 28 which can be, for instance, a flow meter or any type of valve. Using flow control devices 26 and 28, the filler slurries can be combined with the fiber suspension in any desired ratio to produce a cigarette wrapper with a particular permeability.

In order to automatically maintain or adjust the permeability of paper 18 as it is being made, system 10 can also include a permeability measuring device 30 adapted to send information to a microprocessor 32. In one embodiment, permeability measuring device 30 can include a porosity tube that is placed adjacent to paper 18. The porosity tube applies a vacuum to the paper and either measures the flow rate of air entering the tube or the pressure drop over the paper to determine the permeability of the paper.

Permeability measurements taken by measuring device 30 can then be sent to microprocessor 32. As shown, microprocessor 32 is electronically connected and capable of controlling flow control devices 26 and 28. Thus, based on the permeability measurements, microprocessor 32 can be programmed to automatically control the permeability of paper 18 by adjusting the amount and ratio of the filler slurries added to fiber suspension 12. Specifically, microprocessor 32 can be used either to maintain the permeability of paper 18 within a preset range or to automatically change the permeability of paper 18 to a desired level.

The present invention may be better understood with reference to the following examples.

EXAMPLE NO. 1

In order to demonstrate the present invention, various handsheets were made incorporating into the paper two different sized calcium carbonate fillers in different ratios. The fillers used were MULTIFEX filler having a median particle size of 0.07 microns and ALBACAR 5970 filler having a median particle size of 1.9 microns. In all of the handsheets, the total filler loading was 30 percent by weight. The basis weight of each handsheet was also kept constant at 27 gsm. The permeability of each handsheet formed was recorded. A graphical representation of the results are shown in FIG. 2.

Figure 2:
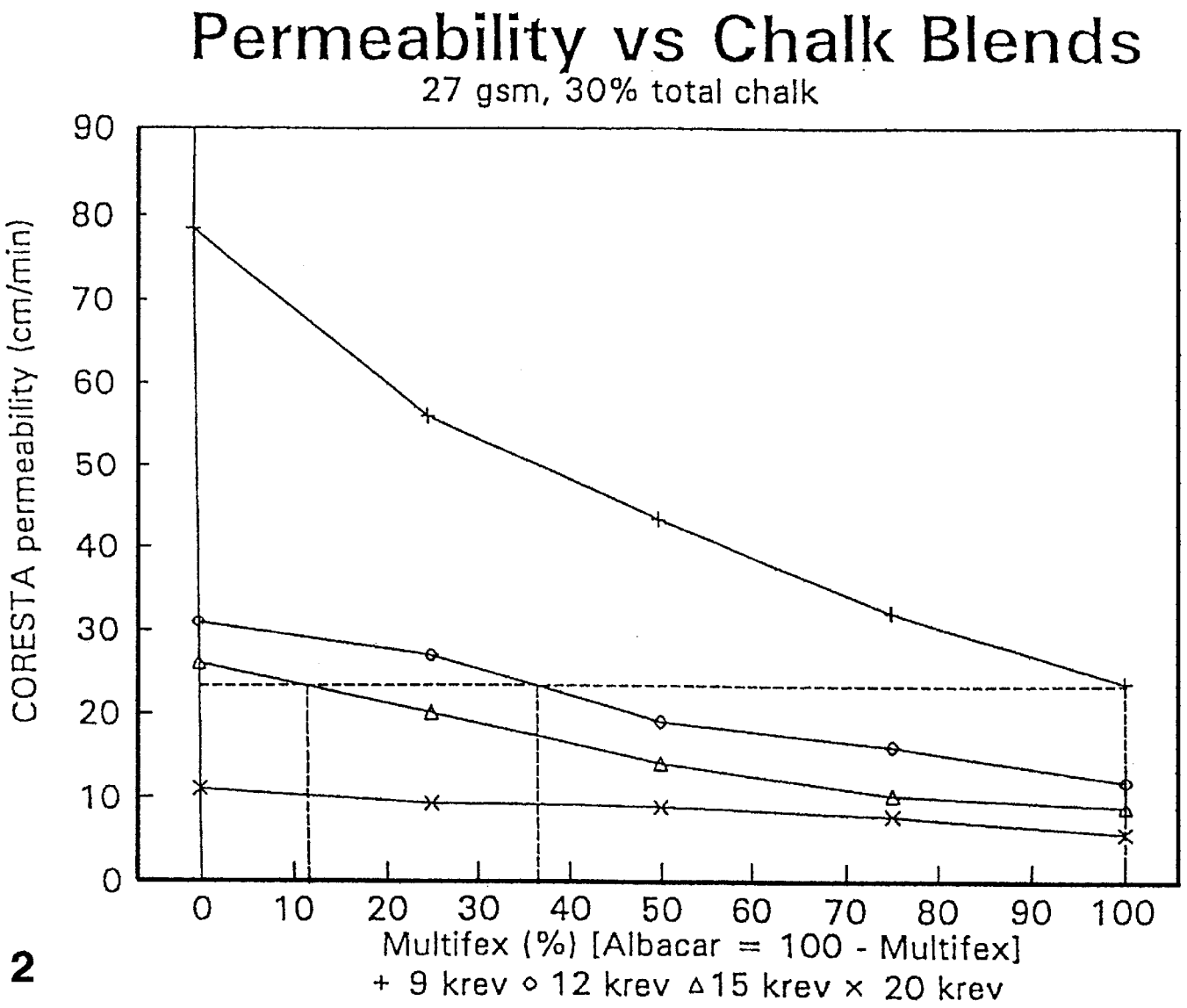
FIG. 2 is a graphical representation of the results obtained in Example 1.

As shown in FIG. 2, during this example the amount of furnish refinement was also varied. Specifically, the furnish used to form the handsheets was refined in a PFI mill. Handsheets were made with fiber furnishes that went through 9,000 revolutions in the mill, 12,000 revolutions in the mill, 15,000 revolutions in the mill and 20,000 revolutions in the mill. As refinement increased, permeability decreased.

As shown in FIG. 2, as the proportionate amount of MULTIFEX filler increased, the permeability of the handsheet decreased. Greater variation in permeability was realized with handsheets made from the least refined stock. In particular, handsheets made from the furnish that went through 9,000 revolutions in the PFI mill resulted in a total permeability variation of approximately 55 Coresta units as the ratio of MULTIFEX to ALBACAR was altered.

The dotted line on the graph illustrates the different formulations that can be used to arrive at a paper with a permeability of 24 Coresta units. In particular, handsheets can be made at this Coresta level using differently refined stock by adjusting the MUTILFEX to ALBACAR ratio.

EXAMPLE NO. 2

Handsheets representing cigarette wrapping paper were also made with different calcium carbonate filler blends. In this example, all of the handsheets were made with fiber stock that had all been refined 12,000 revolutions in the PFI mill. All of the handsheets had a filler loading level of 30 percent by weight and had a basis weight of 27 gsm. The following filler mixtures were tested:

| FILLER NO. 1 | FILLER NO. 2 |
|---|---|
| ALBACAR 5970 (1.9 microns) | MARBLEWHITE (15 microns) |
| ALBACAR 5970 (1.9 microns) | ALBACAR HO (1.2 microns) |
| ALBACAR 5970 (1.9 microns) | ULTRAPAQUE (0.3 microns) |
| ALBACAR 5970 (1.9 microns) | MULTIFEX (0.07 microns) |

Figure 3:
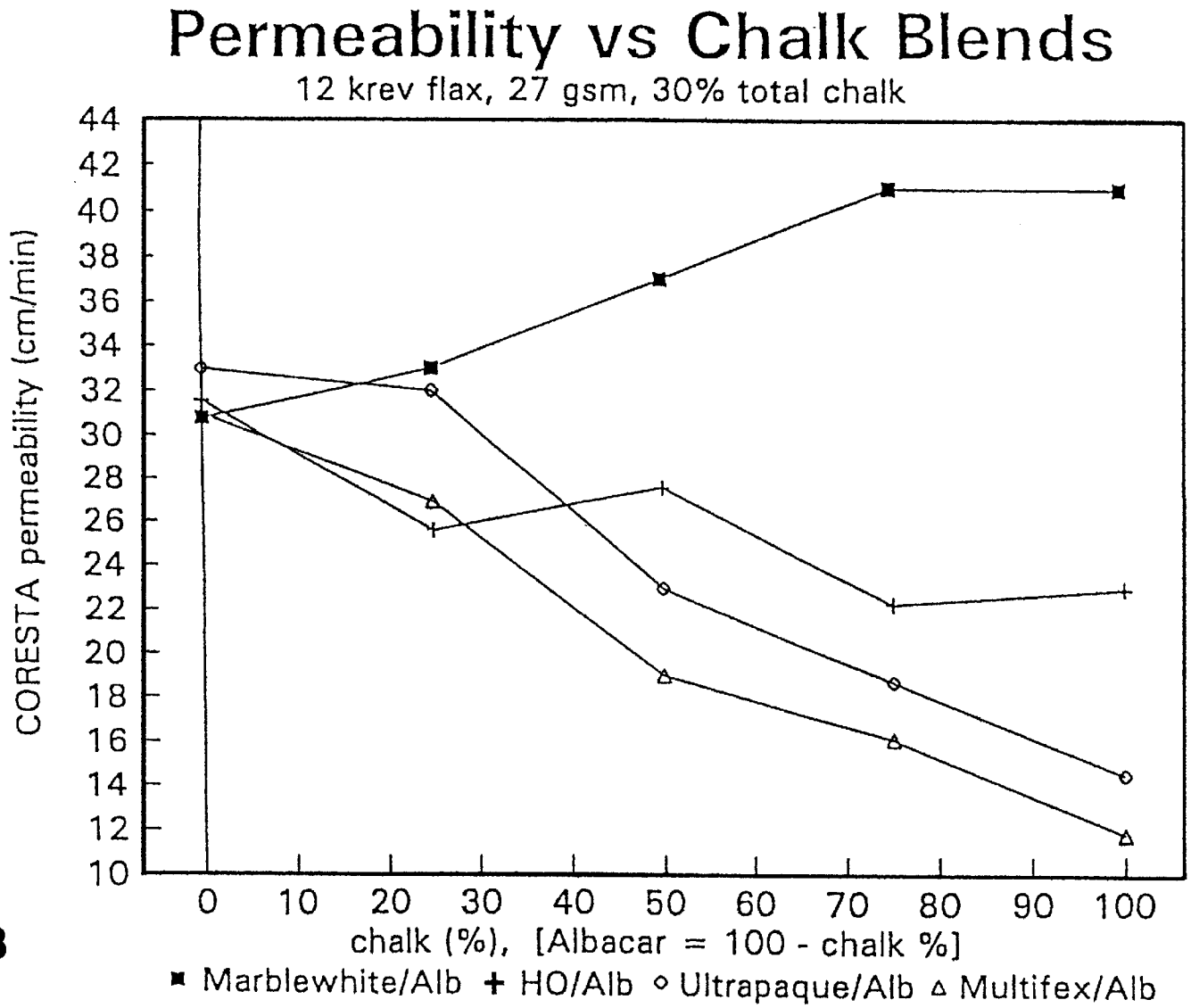
FIG. 3 is a graphical representation of the results obtained in Example 2.

The permeability of each handsheet formed was tested for permeability. The results obtained are graphically illustrated in FIG. 3. Since ALBACAR HO, ULTRAPAQUE and MULTIFEX fillers are smaller in size than ALBACAR 5970, the permeability decreased as the proportion of the smaller calcium carbonate fillers increased. MARBLEWHITE filler, on the other hand, is a larger sized filler than ALBACAR 5970. Thus, in the handsheets made with the MARBLEWHITE/ALBACAR mixture, permeability increased as the proportion of MARBLEWHITE increased.

EXAMPLE NO. 3

Cigarette wrappers incorporating a mixture of ALBACAR 5970 (1.9 microns) and ULTRAPAQUE filler (0.3 microns) were machine made according to the present invention. All of the sample wrappers had a basis weight of 25 gsm and a total filler loading of 28 percent by weight. Each sample also contained 0.6 percent by weight citrate. As the ratio of ALBACAR 5970 to ULTRAPAQUE was varied in the paper, permeability was measured. The following results were obtained:

TABLE I

| | Differences in Permeability as Filler Ratio Is Varied | | |
|---|---|---|---|
| | Filler Ratio (%) | | Permeability |
| Sample No. | ALBACAR 5970 | ULTRAPAQUE | (Coresta) |
| 1 | 100 | 0 | 41 |
| 2 | 79 | 21 | 38 |
| 3 | 57 | 43 | 34 |
| 4 | 33 | 67 | 31 |
| 5 | 14 | 86 | 27 |

As shown above, permeability decreased as the proportion of ULTRAPAQUE filler in the cigarette wrapper increased. A total swing of 14 Coresta units was observed as ULTRAPAQUE concentration went from 0 percent to 86 percent by weight based on the total filler amount.

These and other modifications and variations of the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A process for controlling the permeability of a paper as said paper is formed comprising the steps of:

providing a fiber suspension;

blending said fiber suspension with a mixture of fillers, comprising at least a first filler having a first median particle size and a second filler having a second median particle size, said first particle size being larger than said second particle size, said mixture of said fillers having an average particle size;

forming said fiber suspension into a paper;

determining the permeability of said paper formed from said fiber suspension with a permeability measuring device, said permeability measuring device sending permeability information to a controller configured to adjust the proportionate amounts of said first filler and said second filler contained in said mixture of fillers; and based on said permeability, selectively increasing or decreasing the average particle size of said mixture of fillers using said controller for adjusting the permeability of said paper within a preset range.

2. A process as defined in claim 1, wherein said mixture of fillers is added to said fiber suspension in an amount to achieve a filler loading in said paper of between about 20% to about 40% by weight.

3. A process as defined in claim 1, wherein said fillers have median particle sizes of from about 0.05 microns to about 15 microns.

4. A process as defined in claim 1, wherein said mixture of fillers are added to said fiber suspension in an amount to achieve a filler loading in said paper of between about 25% to about 35% by weight and to achieve a basis weight of from about 18 gsm to about 60 gsm.

5. A process as defined in claim 1, wherein said second filler has a median particle size of from about 0.2 microns to about 0.4 microns and said first filler has a median particle size of from about 1.5 microns to about 2.5 microns.

6. A process as defined in claim 1, wherein said fillers comprise calcium carbonate.

7. A process as defined in claim 1, wherein the permeability of said paper is from about 5 Coresta units to about 80 Coresta units.

8. A process as defined in claim 1, wherein said permeability of said paper is selectively increased or decreased without substantially altering the total filler loading in said paper.

9. A process for controller the permeability of a cigarette wrapper as said wrapper is formed comprising the steps of;

providing a fiber suspension;

blending with said fiber suspension with a first filler from a first filler reservoir, said first filler having a first median particle size;

blending with said fiber suspension a second filler from a second filler reservoir, said second filler having a second median particle size, said second median particle size being greater than said first median particle size;

forming said fiber suspension into a wrapper, said wrapper having a basis weight of from about 18 gsm to about 60 gsm and a total filler loading of from about 20% to about 40% by weight;

determining the permeability of said wrapper formed from said fiber suspension with a permeability measuring device, said permeability measuring device sending permeability information to a controller, said controller being configured to adjust the amount of said first filler and the amount of second filler blended with said fiber suspension; and based on said permeability, selectively increasing or decreasing the proportionate amounts of said first filler and said second filler that are blended with said fiber suspension for automatically adjusting the permeability of said wrapper within a preset range.

10. A process as defined in claim 9, wherein said wrapper has a permeability of from about 5 Coresta units to about 80 Coresta units.

11. A process as defined in claim 9, wherein said wrapper has a permeability of from about 15 Coresta units to about 55 Coresta units.

12. A process as defined in claim 11, wherein said wrapper has a basis weight of from about 22 gsm to about 32 gsm.

13. A process as defined in claim 12, wherein said wrapper has a total filler loading of from about 25% to about 35% by weight.

14. A process as defined in claim 9, wherein said first filler and said second filler have median particle sizes of from about 0.05 microns to about 15 microns.

15. A process as defined in claim 9, wherein said first filler has a median particle size of from about 0.2 microns to about 0.4 microns.

16. A process as defined in claim 9, wherein said permeability of said wrapper is selectively increased or decreased without substantially altering the filler loading in said wrapper.

17. A process for controlling the permeability of a cigarette wrapper as said wrapper is formed comprising the steps of;

providing a fiber suspension;

blending said fiber suspension with a mixture of fillers comprising at least a first filler having a first median particle size and a second filler having a second median particle size, said first particle size being larger than said second particle size, said first particle size being no greater than 15 microns while said second particle size being no less than about 0.05 microns, said mixture of said fillers having an average particle size;

forming said fiber suspension into a wrapper, said wrapper having a basis weight of from about 18 gsm to about 60 gsm and a total filler loading of from about 20% to about 40% by weight;

determining the permeability of said wrapper formed from said fiber suspension with a permeability measuring device, said permeability measuring device sending permeability information to a controller configured to adjust the proportion amounts of said first filler and said second filler blended with said fiber suspension; and based on said permeability, selectively increasing or decreasing the average particle size of said mixture of fillers using said controller for adjusting the permeability of said wrapper within a preset range, said permeability being no less than 5 Coresta units and no greater than 80 Coresta units.

18. A process as defined in claim 17, wherein said permeability of said wrapper is no less than 15 Coresta units and no greater than 55 Coresta units.

19. A process as defined in claim 17, wherein said wrapper has a total filler loading of from about 25% to about 35% by weight.

20. A process as defined in claim 17, wherein said mixture of fillers comprise calcium carbonate, said particle size of said second filler ranging from about 0.2 microns to about 0.4 microns.

* * * * *